United States Patent [19]

Sando et al.

[11] 4,166,367

[45] Sep. 4, 1979

[54] CONTINUOUS MERCERIZING APPARATUS FOR CIRCULAR KNITTED ARTICLES

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 874,157

[22] Filed: Feb. 1, 1978

[30] Foreign Application Priority Data

Apr. 5, 1977 [JP] Japan ..... 52-38788

[51] Int. Cl.[2] ..... D06M 1/02

[52] U.S. Cl. ..... 68/9; 68/13 R; 68/22 R; 68/62; 68/183; 68/205 R

[58] Field of Search ..... 68/9, 13 R, 22 R, 27, 68/62, 175, 183, 205 R; 8/125, 151

[56] References Cited

U.S. PATENT DOCUMENTS

| | | | |
|---|---|---|---|
| 1,577,393 | 3/1926 | Voegeli | 68/13 R X |
| 2,239,636 | 4/1941 | Weiss | 68/9 X |
| 3,124,860 | 3/1964 | Kenyon et al. | 8/125 X |
| 3,508,286 | 4/1970 | Rosen | 68/22 R X |
| 3,686,905 | 8/1972 | Stanway | 68/62 |
| 3,958,432 | 5/1976 | Aronoff | 68/22 R X |

FOREIGN PATENT DOCUMENTS

| | | | |
|---|---|---|---|
| 51-18548 | 6/1976 | Japan | 68/183 |

*Primary Examiner*—Philip R. Coe

*Attorney, Agent, or Firm*—Toren, McGeady and Stanger

[57] ABSTRACT

A process and apparatus for mercerizing circular knitted articles, continuously as well as uniformly to assure that the circular knitted articles can be impregnated uniformly with caustic solution in a predetermined quantity, and the whole parts of the circular knitted articles impregnated with caustic solution are subjected to the timing treatment under an uniform tension, and the circular knitted articles thus treated are subjected to the rinsing treatment efficiently in a short period of time.

1 Claim, 3 Drawing Figures

CONTINUOUS MERCERIZING APPARATUS FOR CIRCULAR KNITTED ARTICLES

BACKGROUND OF THE INVENTION

The present invention relates to an apparatus for continuous mercerization specifically of a long circular cloth.

It has hitherto been well-known to the public a process for mercerizing textile products which are made of yarn, cloth, circular cloth knitted in a form of a cylindrical shape. According to prior arts, however, it has rather been difficult to mercerize continuously as well as uniformly the foregoing circular cloth, because of the fact that, in the course of treatment under mercerization, cloth to be treated is generally subjected to impregnation with caustic solution and is squeezed of said impregnated solution to a predetermined quantity, then put under tension with timing adjustment and finally subjected to a rinsing treatment. Further, when the cloth to be treated is circular knitted article, the edge of circular knitted article to be treated is apt to be impregnated unevenly with said caustic solution resulting in appearance of creases or pleats thereon, and moreover, causing unbalanced tension to be exerted upon the whole width of the treated article in the stage of squeezing the treating solution or the stage of transferring the circular knitted article by means of guide rolls or the stage of loading the tension on the treated article, thus said long circular knitted article cannot be mercerized continuously and uniformly.

The above-mentioned drawbacks in the process for carrying out mercerization of long circular knitted articles according to the prior arts are the problem to be solved urgently.

SUMMARY OF THE INVENTION

The present invention has its object to provide an apparatus for mercerizing circular knitted articles, continuously as well as uniformly to assure that the circular knitted articles can be impregnated uniformly with caustic solution in a predetermined quantity, and the whole parts of the circular knitted articles impregnated with caustic solution are subjected to the timing treatment under an uniform tension, and the circular knitted articles thus treated are subjected to the rinsing treatment efficiently in a short period of time.

The present invention will now be described with reference to the attached drawings by way of example in a form of embodiment of the invention.

DESCRIPTION OF THE PREFERRED EMBODIMENT

Figure 1:
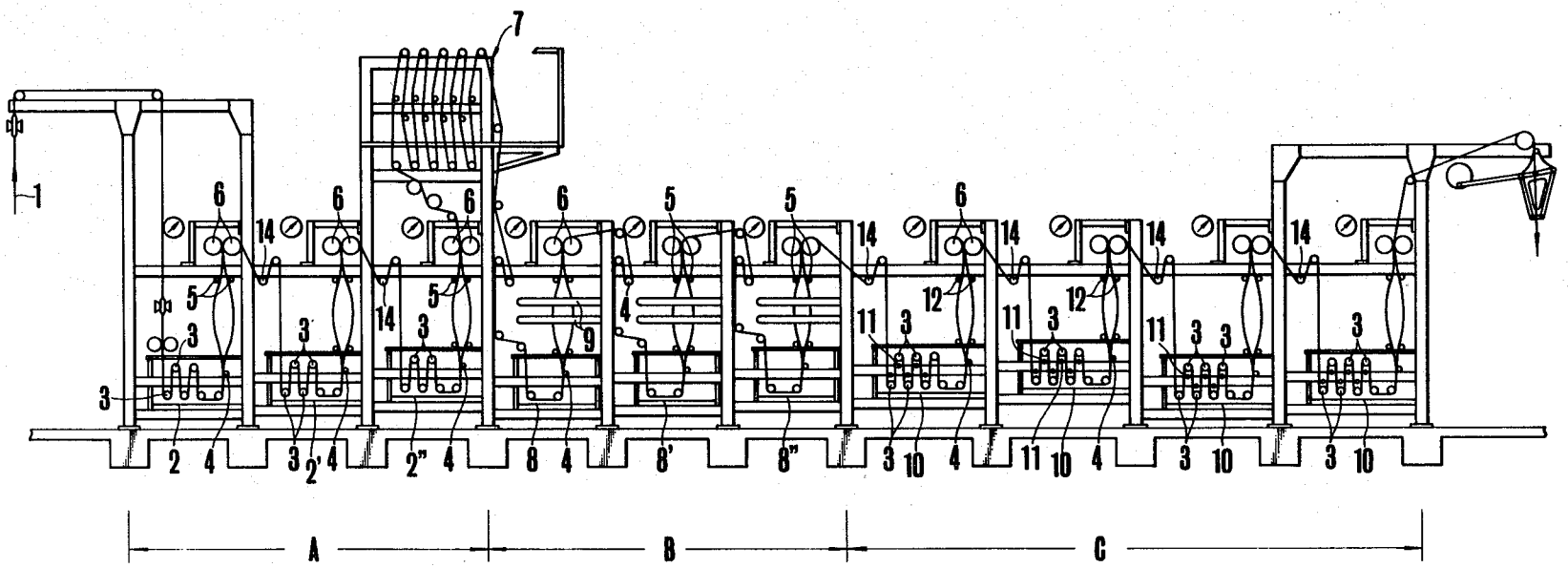
FIG. 1 is a side view of an apparatus for mercerizing circular knitted articles applicable to the process according to the present invention showing the mechanism in the arrangment of the whole constitutional elements.
Figure 2:
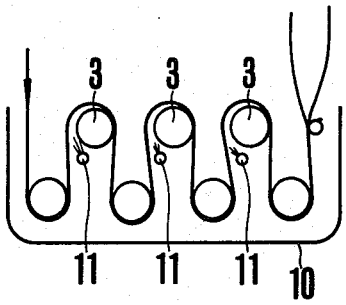
FIG. 2 is a vertical sectional view of a rinsing tank in an enlarged scale.

In FIG. 1, the reference numeral 1 designates circular knitted articles in a flat shape, and the circular knitted articles 1 are initially fed into a first vessel 2 filled with alkali solution arranged in the alkali treating step of process (A). The concentration of the solution filled in said alkali solution vessel 2 is preferably about 27-15%, and the temperature of said solution is desirably in the range from 0° to 50° C. The circular knitted articles 1 fed into the alkali solution vessel 2 is subjected to impregnation abundantly with an excessive amount of solution while being transferred within the solution in a vertically zigzag course introduced by means of guide rolls 3 arranged at the inner part of the alkali solution vessel 2, subsequently the circular knitted articles 1 are discharged from said vessel 2. However, just before the discharge from said vessel 2, said circular knitted articles are blown at the inner part thereof with air blast from an air injection pipe 4 and are expanded to form a cylindrical shape to be stood upright and transferred in an upward direction. The circular knitted articles thus expanded are pressed by means of a pair of pressure rolls 5 each oppositely disposed leaving a space therebetween, thereby the circular knitted articles 1 are loaded with tension in the transverse direction thereof so as to be effectively permeated with alkali solution into the internal part of said circular knitted articles.

In the next step, the circular knitted articles are squeezed of the solution impregnated therewithin by means of pinch rolls 6 and are fed into a second alkali solution vessel 2' to be subjected to the treatment with alkali solution again in the same way as in the initial stage, subsequently fed into a third alkali solution vessel 2" to be treated with alkali solution in the same as the foregoing. The circular articles treated with alkali solution in the alkali treating step (A) are henceforth transferred to a timing treatment station 7 equipped with a number of guide rolls and are subjected to a reaction treatment, then forwarded to the step (B) for recovering the alkali solution. In the alkali solution recovering step (B), the circular knitted articles are initially fed into a first alkali solution recovering vessel 8, within which the circular knitted articles are treated with water at a temperature in the range of 0°-100° C., subsequently just before the discharge from the recovery vessel 8, the circular knitted articles 1 are blown at the inner part thereof with air blast from an air injection pipe 4 to be expanded into a form of a cylindrical shape, then the circular knitted articles thus expanded are sprayed around the outer periphery thereof with solution poured down from a ring shower pipe 9 disposed to encompass the expanded cylindrical knitted articles so as to wash out effectively the alkali solution contained within the expanded knitted articles. In the next stage, after having passed through the pinch rolls 6, the circular knitted articles are subjected to a treatment within a second alkali solution recovering vessel 8' and a third alkali solution recovering vessel 8" in sequence for the recovery of the alkali solution contained therewithin in the same way as in the initial stage, thus the treatment in the alkali solution recovering step (B) is terminated. In the further subsequent stage, the circular knitted articles thus treated for alkali solution recovery are fed to the rinsing step (C) wherein a number of rinsing vessels 10 are disposed in a multistage arrangement which are filled with water having a temperature ranging from 0° to 100° C., each of the rinsing vessels 10 is provided therewithin guide rolls 3 for transferring the circular knitted articles to be guided in a vertically zigzag course as well as air injection pipes 11 for supplying air at the junctions between the guide rolls 3 and the circular knitted articles. Furthermore, within each rinsing vessel 10 an air injection pipe 4 is provided to supply air to the inner part of the circular knitted articles just before being discharged from the vessel 10. Accordingly, the circular knitted articles are expanded into a form of a cylindrical shape due to air sprayed from the air injection pipe 4 and are subjected to stretching treatment so as to have an extended width thereof in the transverse direction by means of tentering rolls 12, and further squeezed of the water content by means of pinch rolls 6, and then fed into the other rinsing vessel 10 disposed at the subsequent stage wherein the circular knitted articles are subjected to the rinsing treatment once more just in the same way as in the foregoing procedure, thus the rinsing treatment is completed before the circular knitted articles have passed throughout all the rinsing vessels 10.

As described hereinbefore, the mercerization of circular knitted articles according to the present invention comprises the step (A) for treating the articles with alkali solution wherein the alkali solution is repeatedly applied for several times to the circular knitted articles under tension loaded thereon in the longitudinal as well as transversal directions thereof, the timing treatment station 7 for imparting the reaction to the circular knitted articles which have passed through the step (A) of treating with alkali solution, the step (B) for recovering alkali solution wherein the alkali solution impregnated within the circular knitted articles thus subjected to the reaction treatment is repeatedly recovered for several times, and the rinsing step (C) wherein the circular knitted articles removed of impregnated alkali solution therefrom are washed repeatedly. However, the apparatus applicable to the mercerization according to the present invention has the following enumerated characteristics in view of construction to constitute the apparatus for carrying out the step (A) of treatment with alkali solution, the step (B) of recovering alkali solution from said circular knitted articles and the rinsing step (C) respectively described hereinbefore. In other words, for the sake of preventing appearance of nip marks on both edges of the circular knitted articles due to constant pleats formed by folding at both sides of the articles as well as uneven treatment with alkali solution on the whole parts thereof when the circular knitted articles are merely transferred under pressure by means of guide rolls or pinch rolls with no provision of any means as a countermeasure for preventing the aforementioned defects. So that, taking the foregoing viewpoint into consideration, the present invention is completed to eliminate the aforementioned defects by staggering the pleats formed on both sides of the circular knitted articles with the help of torsion generated at the expansion of the circular knitted articles into a form of a cylindrical shape while they are transferred from one solution treatment vessel arranged in the initial stage to the other solution treatment vessel disposed in the subsequent stage.

When the circular knitted articles expanded into a form of a cylindrical shape are nipped by a pair of pressure rolls 5 and a pair of tentering rolls 12 respectively, the cylindrically expanded knitted articles are subjected to pressure exerted upon an alternative roll of the paired pressure rolls and tentering rolls to move it obliquely so as to generate torsion on the cylindrically expanded periphery of the knitted articles and to displace the location of pleats formed thereon, thereby staggering of pleats on the expanded knitted articles can favourably be fulfilled.

As an additional result obtained according to the present invention, the ring shower pipes 9 equipped in the alkali solution recovering step (B) to encompass the circular knitted articles are subjected to a spray treatment where solution or liquid is sprayed over the outer periphery of the circular knitted articles having the cylindrically expanded shape, wherefore the good permeability of the sprayed liquid at the outer periphery of said expanded knitted articles results in fulfilment of efficient recovery of the alkali solution, that is, thorough wash-out of the alkali solution.

Moreover, within each of the rinsing vessels 10 disposed in the rinsing treatment step (C), since the air injection pipes 11 are mounted adjacent to the guide rolls 3, blast air blown from the air injection pipes 11 is supplied to the junction between the guide rolls 3 and the knitted articles to trespass between meshes of the knitted articles due to the pressure of the guide rolls forcedly contacting the knitted articles, whereby the rinsing liquid is also caused to trespass between the meshes of the knitted articles with the help of the air permeation action, so that an effective rinsing treatment can advantageously be carried out.

Figure 3:
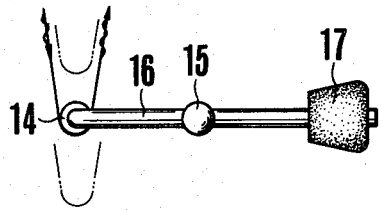
FIG. 3 is a side view of a dancer roll in an enlarged scale showing the detailed structure thereof.

Besides, the reference numeral 14 represents a dancer roll interposed between every two liquid vessels arranged adjacent to each other, and the dancer roll 14 is pivoted to an arm 16 at one end thereof, the arm 16 is pivotally supported at nearly the middle part thereof by a fulcrum shaft 15 as shown in FIG. 3, and at the other end of the arm 16 is mounted with a weight 17 which can adjust the swinging boundary of the arm in the axial direction thereof. Therefore, the tension loaded on the knitted articles to be treated can automatically be adjusted by controlling the location of the weight 17.

In short, features of the present invention lies in that the mercerization of circular knitted articles can effectively be carried out because the caustic solution is applied to the circular knitted articles to be treated in a form of an expanded shape, namely, under the loaded condition in the longitudinal as well as transversal direction thereof, and in the course of transferring the circular knitted articles to the subsequent stage in sequence, the knitted articles are given somewhat a slight torsion so as to stagger the location of pleats formed by folding the knitted articles at both side fringes thereof, whereby uniform mercerization of the whole parts of the circular knitted articles can be achieved. Further, in the course of the alkali solution recovering step (B), the ring shower pipes are employed, moreover, in the course of the rinsing treatment step (C), the blast air is adapted to be sprayed between the guide rolls and the circular knitted articles within each of the rinsing vessels so as to remove the alkali solution effectively as well as to wash out efficiently the circular knitted articles with only a small consumption of rinsing water and rinsing hot water for obtaining the desired objects of the present invention.

What is claimed is:

1. An apparatus for continuous mercerizing a circular knitted article comprising: an alkali solution treating section containing a plurality of alkali solution vessels in a multistage arrangement each of which vessel is provided therewithin with guide rolls disposed alternately in zigzag position in a vertical direction and an air injection pipe for supplying an air blast to expand said article upon leaving the solution within the vessel, a pair of pressure-rolls downstream of each air injection pipe for loading tension on said expanded article in the transverse direction thereof and a pair of pinch rolls downstream of each pair of pressure rolls for squeezing out treating solution; a timing treatment section composed of a number of guide rolls disposed in a plurality of rows for subjecting said squeezed article to a reaction treatment; an alkali solution recovering section containing a plurality of water filled vessels in a multistage arrangement for recovering alkali solution each of which vessel is provided therewithin with an air injection pipe for expanding said knitted article, ring shower pipes downstream of each vessel for spraying treating liquid to wash out the alkali solution impregnated within said knitted article and a pair of pinch rolls downstream of the ring shower pipes for squeezing out the water content of said knitted article; and a rinsing section containing a plurality of water filled vessels in a multistage arrangement each of which vessel is provided therewithin with guide rolls disposed alternately in zigzag position in a vertical direction and air injection pipes for spraying air blasts at the junctions between said guide rolls and the knitted article, each vessel further being provided with an air injection pipe for spraying an air blast to expand said knitted article upon leaving the water within the vessel, a pair of tentering rolls downstream of each air injection pipe for stretching the width of said expanded article in the transverse direction and a pair of pinch rolls downstream of each pair of tentering rolls for squeezing out the water content of said knitted article; and dancer rolls respectively interposed between every two vessels arranged to be adjacent to each other for adjusting the tension loaded on said knitted article.

* * * * *